US007116193B2

(12) United States Patent
Campbell

(10) Patent No.: US 7,116,193 B2
(45) Date of Patent: Oct. 3, 2006

(54) ELECTROMAGNETIC RELAY

(75) Inventor: Robert Campbell, Tecumseh (CA)

(73) Assignee: Hella KGaA Hueck & Co., Lippstadt (DE)

( * ) Notice: Subject to any disclaimer, the term of this patent is extended or adjusted under 35 U.S.C. 154(b) by 0 days.

(21) Appl. No.: 10/951,701

(22) Filed: Sep. 29, 2004

(65) Prior Publication Data

US 2006/0066424 A1 Mar. 30, 2006

(51) Int. Cl.
*H01H 67/02* (2006.01)

(52) U.S. Cl. ..... 335/128; 335/129; 335/83

(58) Field of Classification Search ..... 335/128, 335/83, 129, 130–1

See application file for complete search history.

(56) References Cited

U.S. PATENT DOCUMENTS 4,857,872 A * 8/1989 Bassino ..... 335/80
4,975,739 A * 12/1990 Noda ..... 335/128
5,315,275 A * 5/1994 Hoffmann et al. ..... 335/86
5,748,061 A * 5/1998 Tsutsui et al. ..... 335/83
5,889,451 A * 3/1999 Kern ..... 335/78
6,784,773 B1 * 8/2004 Tsutsui et al. ..... 335/78

* cited by examiner

*Primary Examiner*—Lincoln Donovan
(74) *Attorney, Agent, or Firm*—Birch, Stewart, Kolasch & Birch, LLP

(57) ABSTRACT

A relay is provided that has a base, connecting elements, a magnet system with a coil, a core arranged within the coil, an L-shaped yoke, and a plate-shaped armature, wherein the axis of the coil extends parallel to the first yoke leg, and a second yoke leg is connected to the first end of the core farthest from the base, and wherein the armature is pivoted on the first yoke leg and forms a working air gap with a second end of the core facing the base. A contact system has a contact spring that is fastened to the armature and carries a movable contact, and at least one fixed contact carrier that carries a fixed contact and is anchored in the base. The open end of the first yoke leg is supported on the upper surface of the base with two fork-shaped end sections, while the open end of the second yoke leg is likewise supported on the upper surface of the base by a yoke support parallel to the first yoke leg. The armature is pivoted on a pivot edge formed between the two end sections of the first yoke leg and is fastened to the outer side of the first yoke leg facing away from the coil via a return spring which engages between the end sections.

19 Claims, 3 Drawing Sheets

ELECTROMAGNETIC RELAY

BACKGROUND OF THE INVENTION

1. Field of the Invention

The present invention relates to an electromagnetic relay having a base in which connecting elements are anchored, a magnet system with a coil, a core arranged in the coil, an L-shaped yoke, and a plate-shaped armature. A first yoke leg is arranged essentially parallel to a coil axis and a second yoke leg is connected to a first end of the core. The armature is pivoted on the first yoke leg and forms a working air gap with the second end of the core. The relay further includes a contact system with a contact spring that carries a movable contact and is fastened to the armature, as well as at least one fixed contact carrier that carries a fixed contact and is anchored in the base.

2. Description of the Background Art

Conventional relays of this type are distinguished by compact construction and are used, e.g., to switch large currents, as for example in low-voltage circuits in automobiles and the like. In known relays of this type, it is frequently only possible through great effort to securely fasten the magnet system to the base and set the return force of the return spring.

SUMMARY OF THE INVENTION

It is therefore an object of the present invention to provide a relay such that a magnet system and a base with the contact system can be manufactured and joined together in a simple manner, whereby different embodiments of the coil and contacts can be created for different applications of the relay without great changes in the manufacturing process. The design of the relay must facilitate a favorable configuration of the contact connections and the coil connections in the smallest possible space while still ensuring the necessary insulating spacings between the connections. Moreover, the relay must be easy to assemble; in particular, the air gap between the armature and the coil core, as well as the return force of the return spring, must be adjustable by simple means.

In accordance with an embodiment of the present invention, this object is attained with a relay that has the following features:

a base in which connecting elements are anchored, a magnet system with a coil, with a core arranged within the coil, an L-shaped yoke, and a plate-shaped armature, wherein the coil axis and a first yoke leg arranged parallel thereto are arranged essentially perpendicular to the primary plane of the base and a second yoke leg is connected to the first end of the core farthest from the base, and wherein the armature is pivoted on the first yoke leg and forms a working air gap with a second end of the core facing the base, and a contact system with a contact spring that is fastened to the armature and carries a movable contact, and at least one fixed contact carrier that carries a fixed contact and is anchored in the base, wherein the relay has the following further features:

the open end of the first yoke leg is supported on the upper surface of the base with two fork-shaped end sections, while the open end of the second yoke leg is likewise supported on the upper surface of the base by at least one yoke support parallel to the first yoke leg, and the armature is pivoted on a pivot edge formed between the two end sections of the first yoke leg and is fastened to the outer side of the first yoke leg facing away from the coil by means of a return spring which engages between the end sections.

The support of the first yoke leg on one side of the base surface or the anchoring of the forked ends of this first yoke leg in recesses in the base surface, and the additional support of the free end of the second yoke leg by at least one yoke support on the opposite side of the base, result in a very stable fastening of the magnet system, wherein the adjustment of the working air gap between the coil core and the armature can be carried out very precisely before the yoke support is joined to the second yoke leg. Instead of one yoke support, two or even more yoke supports can be provided, which are then supported at different places on the base if necessary. The at least one yoke support is preferably made of metal and is attached, preferably welded, to a connecting element anchored in the base. Consequently, the support is more reliable than in the case of exclusive support in the base, whose plastic has a different coefficient of thermal expansion than, for example, the metal of the magnet system. However, in order to avoid a short circuit, additional yoke supports should not be fastened to an additional connecting element.

The return spring for the armature extends between the forked ends of the first yoke leg and thus can be fixed to the yoke after the magnet system is assembled on the base; the return force can be set at the same time.

In an advantageous embodiment of the invention, the contact spring is connected by a stranded wire to a spring contact anchored in the base. In this context, the stranded wire can preferably be arranged below the armature in the shape of an arc that extends sideways across the entire width of the armature. In this way the stranded wire simultaneously serves to limit the stroke of the armature.

In a special embodiment of the invention, the connecting elements, in particular the contact connecting elements, can have fork-shaped divided ends. In this way, the relay can be plugged onto rail-shaped electrical supplies. The forked ends are then preferably elastically resilient or are provided with elastically resilient sections in order to ensure the desired plug contact force.

In an alternate embodiment of the present invention a relay includes the following features:

a base in which connecting elements are anchored, a magnet system with a coil, a core arranged within the coil, an L-shaped yoke, and a plate-shaped armature, wherein a first yoke leg is arranged essentially parallel to the coil axis and a second yoke leg is connected to a first end of the core, and wherein the armature is pivoted on the first yoke leg and forms a working air gap with a second end of the core, and a contact system with a contact spring that carries a movable contact and is fastened to the armature, a fixed contact carrier that carries a fixed contact and is anchored in the base, and the following further features:

the armature is pivoted on a pivot edge of the first yoke leg and is fastened to the outer side of the first yoke leg facing away from the coil by means of a return spring which engages around the pivot point, wherein the attachment point of the return spring on the first yoke leg can be changed to adjust the return force.

In order to adjust the return force during installation of the return spring, an adjusting screw can be used that could be screwed into the yoke leg to a greater or lesser degree to bring the return spring closer to the outer side of the yoke leg in the desired manner and thus preload the return spring.

Such an assembly process would be very complicated, however. Therefore, an advantageous refinement of the invention provides a boss, for example a stamped boss, that extends outward from the yoke leg; a hole in the return spring is pushed onto the boss until the desired return force is reached, and is then fixed in the position thus reached. To this end, for example, the boss can be deformed by orbital riveting until the return spring has reached the end position. In another, particularly advantageous embodiment, a hole in the return spring can have a smaller diameter than the boss, the edge of the hole being interrupted by slits arranged in a ray-like manner to form spring tabs. For adjustment, the hole in the return spring is then pressed onto the boss until the desired return force is achieved. In this position, the tabs spread around the circumference of the boss and ensure the fastening of the return spring on the boss.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
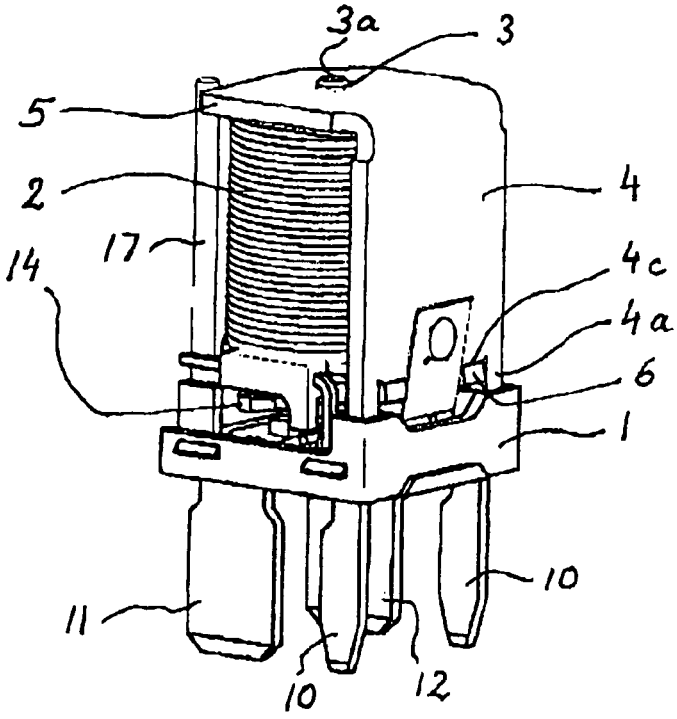
FIG. 1 illustrates a relay according to an embodiment of the invention in a 3D representation (less housing cap)
Figure 2:
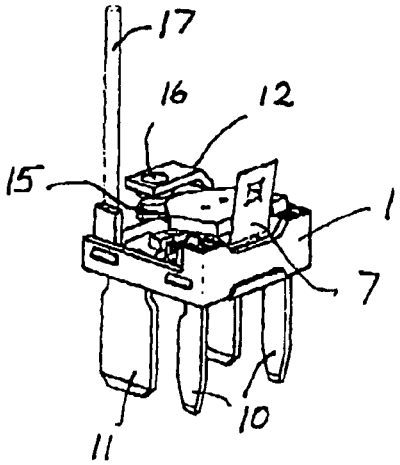
FIG. 2: shows a base assembly for the relay from FIG. 1, having contact elements and coil connecting elements, armature and armature spring.
Figure 3:
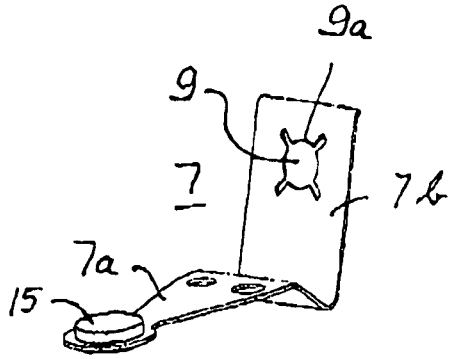
FIG. 3 shows an armature spring for the relay from FIG. 1.

The relay shown in FIGS. 1 through 5 has a base 1 made of insulating material, on which are arranged a magnet system with a coil 2, a core 3 being arranged inside the coil, an L-shaped yoke with a first yoke leg 4 and a second yoke leg 5. A first end 3*a* of the core is connected to the second yoke leg 5. An axis of the coil 2 is essentially perpendicular to a primary plane of the base, as is the first yoke leg 4, which is arranged parallel to the coil axis. An essentially flat armature 6 is arranged between the coil 2 and the base 1; it is pivoted on a free end of the first yoke leg 4 and forms a working air gap with a second end 3*b* of the core 3.

The armature 6 is held by an armature spring 7 which serves as a contact spring with a contact section 7*a* and as a return spring with a return section 7*b*. The contact section 7*a* is connected to the armature, for example by riveting or other means. The center section of the armature spring 7 has a curved section 7*c* with which it engages around a pivot point of the armature on the first yoke leg 4. The contact section 7*a* encloses an angle of more than 90° with the fastening section, at least in the relaxed state, so that the contact section with the armature 6 is held away from the core end 3*b* in the rest state of the magnet system when the return section 7*b* is fastened to the outer side of the yoke leg 4.

For fastening the armature spring 7, the yoke leg 4 has a boss 8 extending outward, which can for example be produced by stamping. For fastening on the boss 8, the return leg 7*b* has a hole 9 whose diameter is slightly less than the diameter of the boss 8. Moreover, multiple slits extend outward from the circumference of the hole 9 in a ray-like or cruciform manner, forming four spring tabs 9*a* in the example shown. Naturally, the number of slits and spring tabs could also be different from four. When the return leg 7*b* is pressed onto the boss 8 with force, the spring tabs 9*a* are resiliently bent outward, and they catch in the circumference of the boss 8 such that the return leg 7*b* is secured against being pushed back.

Two coil connecting elements 10 are anchored in the base. Moreover, in the present example the base carries two contact connecting elements, namely a spring connection 11 and a fixed contact connection 12. All connecting elements are anchored by being inserted in slots in the base 1, and if necessary, by notches 13. The spring connection 11 is connected through a stranded wire 14 to a spring contact or movable contact 15 at the free end of the contact section 7*a*. The stranded wire 14 lies below the armature 6 in the shape of an arc; in this way, the stroke of the armature 6 is limited without additional means. The fixed contact connection 12 carries at its angled free end a fixed contact 16 which forms a switch contact pair together with the spring contact 15. Also fastened to the spring connection 11 is a yoke support 17 made of sturdy steel wire, which is located parallel to the first yoke leg 4 on the opposite side of the coil. An additional support could also be provided at the other corner of the yoke leg 5; however, in order to avoid a short circuit, this additional support must not be connected to the other contact connection.

Figure 4:
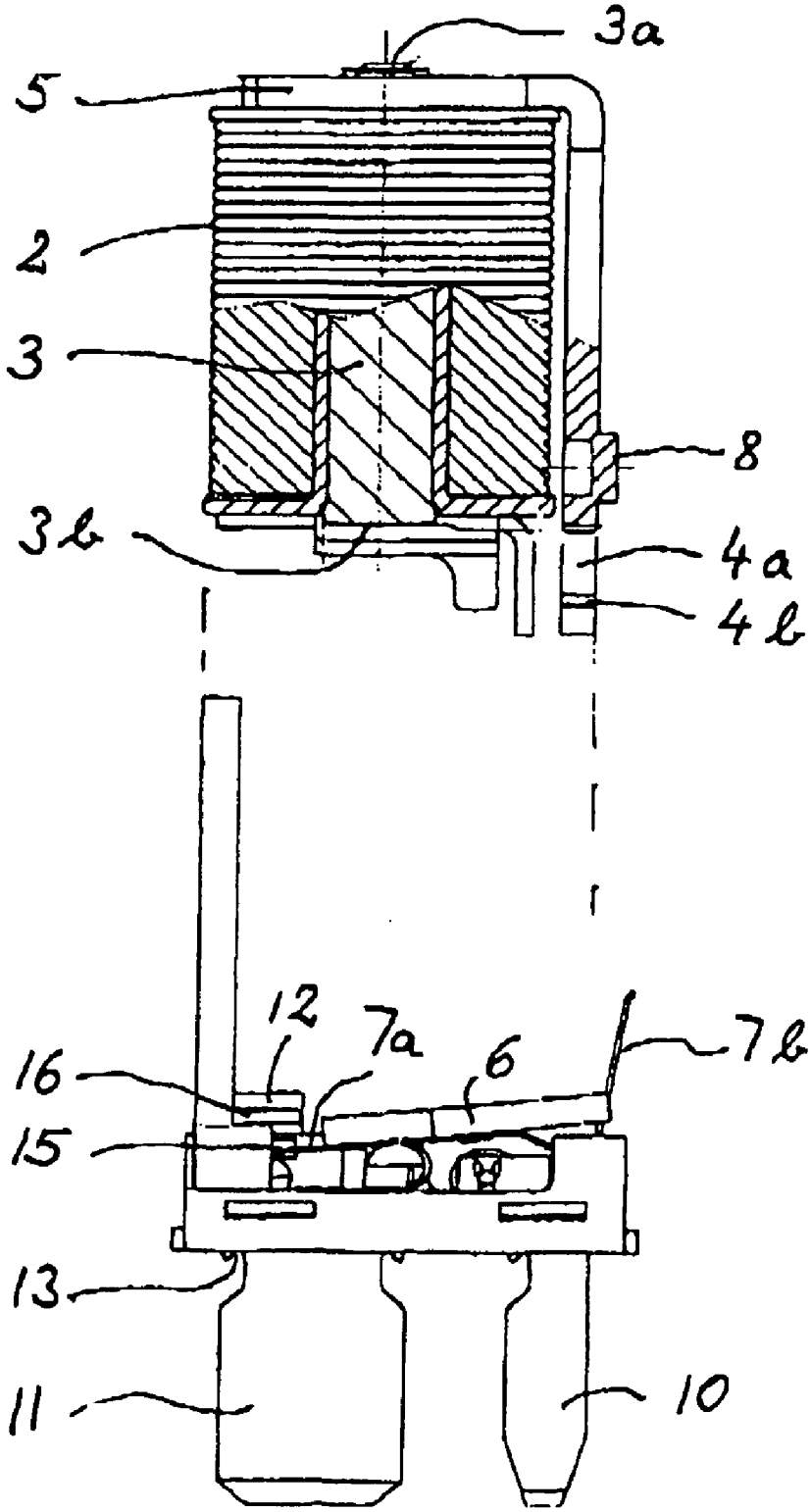
FIG. 4 shows a base assembly and magnet system of the relay from FIG. 1 during assembly in a side view.

During assembly of the relay, the base assembly (see FIG. 2) and the coil assembly are first assembled individually, and then these two assemblies are joined as shown in FIG. 4. The first yoke leg has two projections 4*a* arranged in a fork-like manner and shaped with toothlike indentations 4*b* to anchor the yoke leg in recesses 1*a* in the base. The yoke with these projections 4*a* is pushed onto the base, with the armature 6 lying between the two projections 4*a* and coming into contact with the pivot edge 4*c*. The yoke with the projections 4*a* is pressed into the recesses 1*a* until the air gap distance between the armature 6 and the core 3*b* has the prescribed size. The yoke support 17 is then welded or soldered to the second yoke leg 5.

Figure 5:
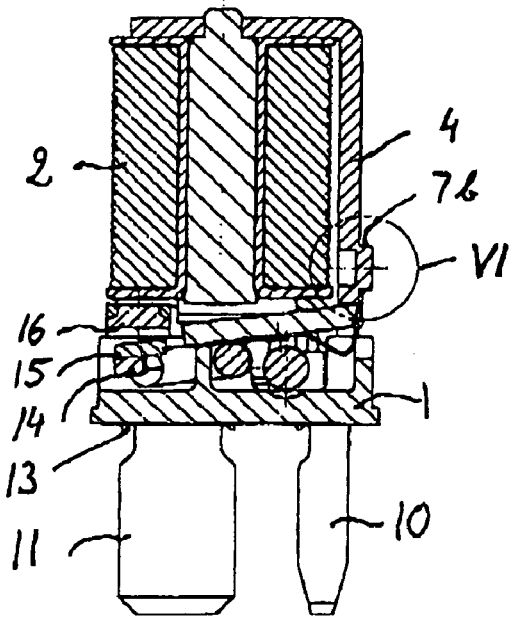
FIG. 5 illustrates the relay from FIG. 1 in a cross-sectional side view.
Figure 6:
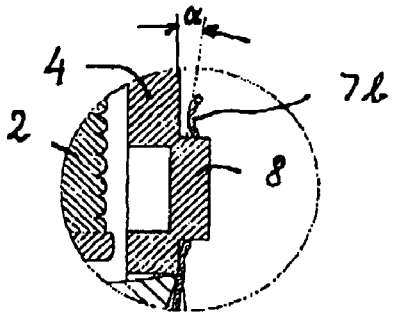
FIG. 6 is a detail view VI of the fastening of the armature spring from FIG. 5.

To fasten the armature spring 7 and to set the armature return force, the return leg 7*b* is then pressed onto the boss 8 as shown in FIG. 5 and in the detail view in FIG. 6. In this process, the hole 9 in the return leg, with its spring tabs 9*a*, is pressed onto the boss until the desired return force is reached. The closer the return leg 7*b* lies to the yoke leg 4, or the smaller the angle $\alpha$ (FIG. 6) is, the greater the return force is.

Figure 7:
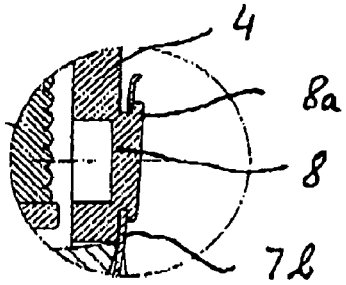
FIG. 7 shows a different fastening option for the armature spring from that in FIG. 6.

Another possibility for fastening and setting the armature spring is shown in FIG. 7. Here, the return leg 7*b*, whose hole in this case has the same diameter as the boss 8, is pushed onto the boss 8, and thereafter the free end of the boss is deformed into a rivet head 8*a*. In this process, the boss becomes progressively shorter and the return leg 7*b* is pushed progressively closer to the yoke leg 4. When the desired return force is reached, the return leg 7*b* is also fixed in place.

As can be seen from FIG. 1, the connecting elements are arranged in two rows, where each coil connection 10 is aligned with a contact connection 11 or 12. The two coil connections here are arranged partially under the projections 4*a* of the yoke leg 4, without coming into contact with them, while the contact connections are located on the opposite side of the base. This novel contact configuration (footprint) of the relay permits an especially compact construction. The relay is covered in the conventional manner with a housing cap that is not shown.

Figure 8:
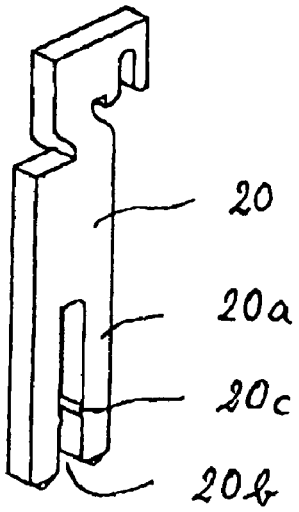
FIGS. 8 and 9 illustrate two different embodiments of the contact connecting elements having fork-shaped ends.
Figure 9:
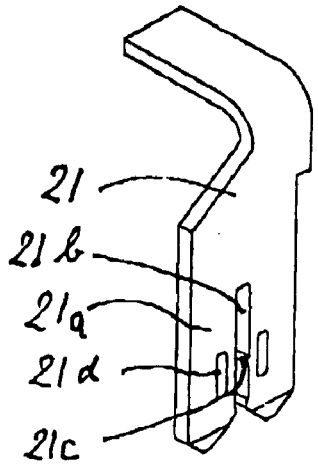

FIGS. 8 and 9 show an additional embodiment of the connecting elements with fork-shaped divided ends. FIG. 8 shows a coil connecting element 20 with forked ends 20*a*, while FIG. 9 shows a contact connecting element 21 with forked ends 21*a*. As a result of the forked design, the forked ends are slightly elastic, so that they deflect elastically and produce a contact force when the push-on slots 20*b* or 21*b* between the forked ends are pushed onto a contact rail. Especially in the case of very wide contact elements, as shown for example in FIG. 9, it is useful to provide longitudinal recesses 21*d* in the forked ends near the push-on slots 21*b* to improve the elastic effect. Contact ribs 20*c* and 21*c* can be provided in the respective push-on slots to create defined contact points.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

The invention claimed is:

1. An electromagnetic relay comprising:

a base in which connecting elements are anchored;

a magnet system having a coil, a core being arranged within the coil, an L-shaped yoke, and a plate-shaped armature, a coil axis being arranged parallel to a first yoke leg and arranged essentially perpendicular to a primary plane of the base, a second yoke leg being connected to a first end of the core farthest from the base, the armature being pivoted on the first yoke leg and forming a working air gap with a second end of the core facing the base; and a contact system with a contact spring that is fastened to the armature and carries a movable contact, and at least one fixed contact carrier that carries a fixed contact and is anchored in the base, wherein an open end of the first yoke leg is supported on an upper surface of the base with two fork-shaped end sections, while an open end of the second yoke leg is supported on the upper surface of the base by at least one yoke support parallel to the first yoke leg, and wherein the armature is pivoted on a pivot edge formed between the two fork-shaped end sections of the first yoke leg and is fastened to an outer side of the first yoke leg facing away from the coil by a return spring, which engages between the fork-shaped end sections of the first yoke leg, wherein at least an end portion of the connecting elements have fork-shaped divided end sections to form push-on slots configured to be pushed onto electrical rails.

2. The relay according to claim 1, wherein the at least one yoke support comprises a metal pin attached at one end to a contact connecting element and at its other end to the second yoke leg.

3. The relay according to claim 1, wherein the contact spring is part of an armature spring which has as a contact spring, a contact section connected to the armature, a curved section surrounding the pivot edge, and a return section fastened to the first yoke leg.

4. The relay according to claim 3, wherein one of the connection elements anchored in the base comprises a spring contact connected to the contact section by a stranded wire located below the armature and extending over a full width of the armature in a shape of an arc.

5. The relay according to claim 1, wherein the fork-shaped divided end sections of the connecting elements have elongated recesses near the push-on slots.

6. The relay according to claim 3, further comprising a boss formed on the first yoke leg and that engages in a hole in the return section of the armature spring, wherein the return section is configured to be fastened on the boss at a selectable distance from a surface of the first yoke leg.

7. The relay according to claim 6, wherein the distance from the return section to the surface of the first yoke leg and a setting of a return force is set by deforming the boss into a rivet head.

8. The relay according to claim 6, wherein the hole in the return section has a smaller diameter than the boss, and wherein the return section includes slits arranged at an edge of the hole in a ray-like manner to form multiple spring tabs which secure the armature spring on the boss.

9. An electromagnetic relay comprising:

a base in which connecting elements are anchored;

a magnet system with a coil, a core arranged within the coil, an L-shaped yoke, and a plate-shaped armature, wherein a first yoke leg is arranged essentially parallel to a coil axis and a second yoke leg is connected to a first end of the core, the armature being pivoted on the first yoke leg and forming a working air gap with a second end of the core; and a contact system with a contact spring that is fastened to the armature and carries a movable contact, and at least one fixed contact carrier that carries a fixed contact and is anchored in the base, wherein the armature is pivoted on a pivot edge of the first yoke leg and is fastened to an outer side of the first yoke leg facing away from the coil by a return spring, which engages around the pivot edge, and wherein an attachment point of the return spring on the first yoke leg can be changed to adjust a return force of the return spring, and wherein at least an end portion of the connecting elements have fork-shaped divided end sections to form push-on slots configured to be pushed onto electrical rails.

10. The relay according to claim 9, wherein the contact spring is part of an armature spring which has as a contact spring, a contact section connected to the armature, a curved section surrounding the pivot edge, and a return section fastened to the first yoke leg as the return spring.

11. The relay according to claim 10, further comprising a boss formed on the first yoke leg and that engages in a hole in the return section of the armature spring, wherein the return section is configured to be fastened on the boss at a selectable distance from a surface of the first yoke leg.

12. The relay according to claim 11, wherein the distance from the return section to the surface of the first yoke leg and a setting of the return force is set by deforming the boss into a rivet head.

13. The relay according to claim 11, wherein the hole in the return section has a smaller diameter than the boss, and wherein the return section includes slits arranged at an edge of the hole in a ray-like manner to form multiple spring tabs which secure the armature spring on the boss.

14. An electromagnetic relay, comprising:

a base having a pair of coil connecting elements and a pair of contacting connecting elements;

a magnet system having a coil, a core arranged within the coil, an L-shaped yoke surrounding a portion of the coil, and a pivotable armature; and a contact spring fastened to the armature and configured to contact an end of one of the contacting connecting elements when a first current is applied to the magnet system through the coil connecting elements such that a second current travels through the contacting connecting elements, wherein the L-shaped yoke includes forked-shaped ends configured to be inserted into recesses of the base.

15. The relay according to claim 14, further comprising:

at least one yoke support supporting an opened end of the L-shaped yoke, said at least one yoke support comprising a metal pin attached at one end to one of the contact connecting elements and at its other end to the opened end of the L-shaped yoke.

16. The relay according to claim 14, wherein at least an end portion of the connecting elements have fork-shaped divided end sections to form push-on slots configured to be pushed onto electrical rails.

17. The relay according to claim 16, wherein the fork-shaped divided end sections have elongated recesses near the push-on slots.

18. The relay according to claim 14, further comprising a boss formed on the L-shaped yoke and that engages in a hole in the contact spring so as to fasten the contact spring to the L-shaped yoke.

19. The relay according to claim 18, wherein the hole in the contact spring has a smaller diameter than the boss and the contact spring includes slits arranged at an edge of the hole in a ray-like manner to form multiple spring tabs which secure the contact spring on the boss.

* * * * *